US005123354A

United States Patent [19]

Loos

[11] Patent Number: 5,123,354

[45] Date of Patent: Jun. 23, 1992

[54] CLEANING DEVICE FOR A PRINTING PRESS

[75] Inventor: Gerhard Loos, Horrenberg, Fed. Rep. of Germany

[73] Assignee: Heidelberger Druckmaschinen AG, Heidelberg, Fed. Rep. of Germany

[21] Appl. No.: 669,752

[22] Filed: Mar. 15, 1991

[30] Foreign Application Priority Data

Mar. 15, 1990 [DE] Fed. Rep. of Germany ..... 4008159

[51] Int. Cl.[5] ..... B41F 35/00; B41L 41/00

[52] U.S. Cl. ..... 101/425; 101/423

[58] Field of Search ..... 101/425, 423

[56] References Cited

U.S. PATENT DOCUMENTS

| | | | |
|---|---|---|---|
| 4,537,130 | 8/1985 | Theilacker | 101/425 |
| 4,651,644 | 3/1987 | Kaempfe et al. | 101/423 |
| 4,703,692 | 11/1987 | Kaempfe et al. | 101/425 |
| 4,953,463 | 9/1990 | Hara | 101/425 |
| 5,012,739 | 5/1991 | Loos et al. | 101/425 |

FOREIGN PATENT DOCUMENTS

| | | |
|---|---|---|
| 0299193 | 1/1989 | European Pat. Off. . |
| 2316608 | 3/1975 | Fed. Rep. of Germany . |
| 8809032 | 10/1988 | Fed. Rep. of Germany . |
| 3909114 | 9/1990 | Fed. Rep. of Germany . |

*Primary Examiner*—Edgar S. Burr
*Assistant Examiner*—Lynn D. Hendrickson
*Attorney, Agent, or Firm*—Herbert L. Lerner; Laurence A. Greenberg

[57] ABSTRACT

A cleaning device for a printing press for cleaning a rotating outer cylindrical surface of a roller or cylinder by a cleaning-cloth web having a given width and edges extending perpendicularly to generating lines of the outer cylindrical surface includes a diaphragm subjectible to pressure at one side thereof by a pressurized fluid for pressing a section of the cleaning-cloth web against the outer cylindrical surface, the diaphragm being formed with a raised first surface region matching the given width of the cleaning-cloth web and being engageable with the cleaning-cloth web, the diaphragm having a surface with second surface regions facing towards the cleaning-cloth web, the second surface regions being offset by a step with respect to the first surface region.

4 Claims, 3 Drawing Sheets

CLEANING DEVICE FOR A PRINTING PRESS

The invention relates to a cleaning device for a printing press and, more specifically, for cleaning a rotating outer cylindrical surface of a roller or a cylinder, for example, for cleaning a rubber blanket of a rubber-blanket cylinder of an offset printing press, by means of a cleaning-cloth web having edges extending perpendicularly to imaginary lines generating the outer cylindrical surface, a diaphragm being provided which, when subjected to pressure on one side thereof by a pressurized fluid, presses a section of the cleaning-cloth web against the outer cylindrical surface.

Such a cleaning device has become known heretofore, for example, from FIG. 6 of European Published Prosecuted Patent Application No. (EP-A2) 02 99 193 and from the appertaining description thereof. A pressure chamber is provided in this case for the application of pressure from a pressurized fluid to one side of a diaphragm forming a wall of the chamber. A cleaning-cloth web extends between an outer cylindrical surface of a rubber blanket mounted on a rubber-blanket cylinder of an offset printing press and a surface of the diaphragm facing towards the outer cylindrical surface. In such cleaning devices, the width of the cleaning-cloth web is slightly greater than a working o useful width achievable with the offset printing press. This measure creates a first precondition for ensuring that the outer cylindrical surface can be cleaned over an area which is slightly wider than the working or useful width, thus also actually permitting it to be cleaned over the entire working width. As a further precondition, however, assurance must also be provided that the cleaning-cloth web is pressed against the outer cylindrical surface over such a width that the area of contact or engagement of the cleaning-cloth web is slightly wider than the working or useful width.

In order to ensure a defined minimum value for the force of contact or engagement of the cleaning cloth web against the outer cylindrical surface over the entire working or useful width, the diaphragm must be arched or bulging due to the pressurized fluid so that the diaphragm exerts a force of contact or engagement of a given minimum value also upon the edges of the cleaning-cloth web. This can only be achieved with sufficient certainty, however, when the distance which the diaphragm extends in a direction transverse to the cleaning-cloth web exceeds the width of the cleaning-cloth web. In this connection, however, in end regions of the diaphragm located outside or beyond the cleaning-cloth web, the diaphragm presses against the outer cylindrical surface with a given force, which can possibly result in damage to the diaphragm at the end regions thereof.

Although this situation could be remedied by an appropriate and marked widening of the cleaning-cloth web, this would, however, only shift the costs incurred by regular replacement of the diaphragm to the additional costs resulting from the provision of a wider cleaning-cloth web.

It is accordingly an object of the invention to provide a cleaning device for a printing press of the foregoing general type which affords low-cost operation.

With the foregoing and other objects in view, there is provided in accordance with the invention, a cleaning device for a printing press for cleaning a rotating outer cylindrical surface of a roller or cylinder by means of a cleaning-cloth web having a given width and edges extending perpendicularly to generating lines of the outer cylindrical surface, comprising a diaphragm subjectible to pressure at one side thereof by means of a pressurized fluid for pressing a section of the cleaning-cloth web against the outer cylindrical surface, the diaphragm being formed with a raised first surface region slightly smaller in length than the given width of the cleaning-cloth web and being engageable with the cleaning-cloth web, the diaphragm having a surface with second surface regions facing towards the cleaning-cloth web, the second surface regions being offset by a step with respect to the first surface region.

By the features according to the invention, namely wherein the diaphragm is constructed so that it is formed with a raised first surface region matching the given width of the cleaning-cloth web and being engageable with the cleaning-cloth web, and the diaphragm has a surface with second surface regions facing towards the cleaning-cloth web, the second surface regions being offset by a step with respect to the first surface region, assurance can be provided that the diaphragm, which is subjected to pressure at one side thereof by a pressurized fluid, does not come into contact with the outer cylindrical surface at any point thereof.

For this purpose, the raised surface region of the diaphragm is dimensioned and disposed in such a manner that it extends in a direction transverse to the cleaning-cloth web between the web edges of the cleaning-cloth web and has a width which is slightly less than that of the cleaning-cloth web. Surface regions of the diaphragm which are situated outside or beyond the width of the raised surface region and are offset by the step cannot then contact either the cleaning-cloth web or the outer cylindrical surface. This rules out the possibility of damage which might otherwise occur as a result of friction between the diaphragm and the rotating outer cylindrical surface.

In accordance with another feature of the invention, the diaphragm is formed of rubber-elastic material and, while a basically uniform wall thickness of the diaphragm is maintained, the step is formed in a region of the diaphragm facing towards the cleaning-cloth web.

The desired success is accordingly ensured just by a surprisingly simple and minor modification to the geometry of a diaphragm of the type, for example, which is heretofore known from the aforementioned European Patent Publication (EP-A2) 02 99 193. Care must be taken only that, when the diaphragm is subjected to pressure at one side thereof by the pressurized fluid, there is such an arching or bulging of the diaphragm that the raised surface region presses the cleaning-cloth against the outer cylindrical surface over the full extent of the raised surface region in the direction transverse to the cleaning-cloth web. It is thus necessary merely to match the pressure of the fluid and the extent to which the offset surface regions of the diaphragm are situated outside or beyond the cleaning-cloth web.

Such matching is accomplished, even when a relatively short length of the offset surface regions of the diaphragm extends outside of or beyond the cleaning-cloth web, in accordance with a further feature of the invention, wherein the offset second surface regions have a wall thickness smaller by the height of the step than the wall thickness of a region of the diaphragm forming the raised first surface region.

In this case, therefore, the required installation space for the cleaning device extending in a transverse direction to the cleaning-cloth web is not very much greater than the width of the cleaning-cloth web, with the result that spacesaving installation conditions derive from the deformation behavior of the diaphragm in the end regions thereof which, because of the smaller wall thickness, afford greater curvatures.

The diaphragms used for the conventional cleaning devices described in the introduction hereto usually have an elongated form, with the longitudinal extent or length thereof depending upon the hereinaforementioned working or useful width. If a corresponding pressure chamber is sealed by means of such a diaphragm, and a pressurized fluid is introduced into the pressure chamber, then, in conventional diaphragms (such as, for example, in the diaphragm of FIG. 6 of European Patent Application No. (EP-A2) 0 299 193), relatively great differences in the contour of the diaphragm surface facing the cleaning-cloth web are produced in consecutive imaginary sections taken in planes perpendicular to the longitudinal extension, particularly in the vicinity of the narrow sides of the diaphragm. When such diaphragms are used in a cleaning device of the hereinaforementioned type, even when identical geometry and identical installation conditions exist, the result is that the outline of the section of the cleaning-cloth web which is pressed against the outer cylindrical surface is difficult to predict and is dependent upon several factors (such as, for example, the pressure of the fluid, the elasticity of the diaphragm material, and the wall thickness of the diaphragm). In general, it can be assumed that this section will taper toward a narrow side of the diaphragm. A consequence thereof, however, is that, along the outer cylindrical surface to be cleaned, different lengths of the cleaning-cloth web are involved in the cleaning process, and the cleaning result obtained is consequently correspondingly non-uniform.

This can be countered in accordance with a concomitant feature of the invention wherein the diaphragm is formed with first body edges partly defining the raised first surface region, the first body edges being formed by the step and extending parallel to edges of the cleaning-cloth web and laterally bordering a central region of the raised first surface region, the first body edges being respectively disposed between and at a slight distance from the edges, respectively, of the cleaning-cloth web, respective ends of each of the first body edges being adjoined by respective second body edges partly defining the raised first surface region of the diaphragm, the second body edges, respectively, laterally bordering a respective edge region adjoining the central region of the raised first surface region, the edge regions, respectively, being narrower than the cleaning-cloth web at least at a given distance from the central region of the raised first surface region.

The proposed feature for forming the edge regions adjoining the central region of the raised first surface region has a beneficial effect on the deformation behavior of the diaphragm under the pressure of the fluid so that, as a result of this feature, it is possible largely to prevent the aforementioned differences in the contour of the diaphragm surface facing the cleaning-cloth web in consecutive imaginary sections taken in planes perpendicular to the longitudinal extension or length of the diaphragm within the region of the diaphragm forming the raised first surface region, as viewed in the direction of the first body edges laterally bordering the raised first surface region Assurance can thus be provided that the section of the cleaning-cloth web which is pressed against the outer cylindrical surface undergoes, at most, an as yet insignificant tapering as viewed in the direction of the edges of the cleaning-cloth web. The optimum course of the second body edges can be determined readily by a person of ordinary skill in the art, it being possible to obtain different outlines of edge regions of the raised first surface region, for example, by suitably removing material forming the diaphragm. The material may be removed, for example, by grinding.

Other features which are considered as characteristic for the invention are set forth in the appended claims.

Although the invention is illustrated and described herein as embodied in a cleaning device for a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing, in which.

Figure 1:
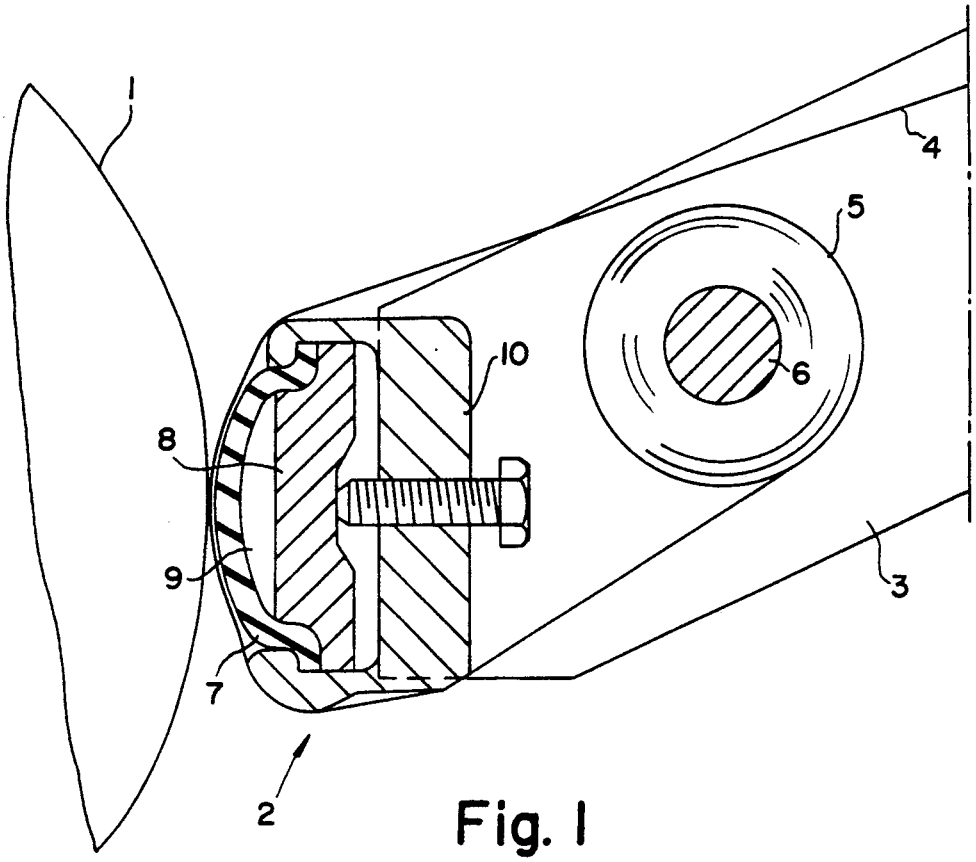
FIG. 1 is a diagrammatic cross-sectional view of a cleaning device for a printing press according to the invention in an operating phase thereof wherein a cleaning-cloth web is pressed by a diaphragm under fluid pressure against an outer cylindrical surface to be cleaned, the cross-sectional plane being perpendicular to generating lines of the outer cylindrical surface.
Figure 2:
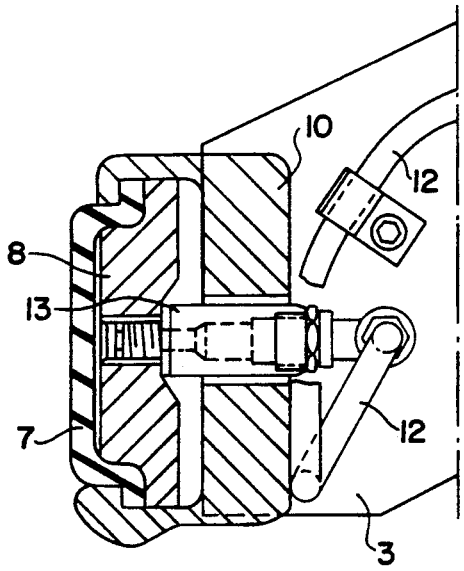
FIG. 2 is a fragmentary cross-sectional view of FIG. 1 taken along a plane parallel to the cross-sectional plane in FIG. 1 wherein the diaphragm is not under fluid pressure.
Figure 3:
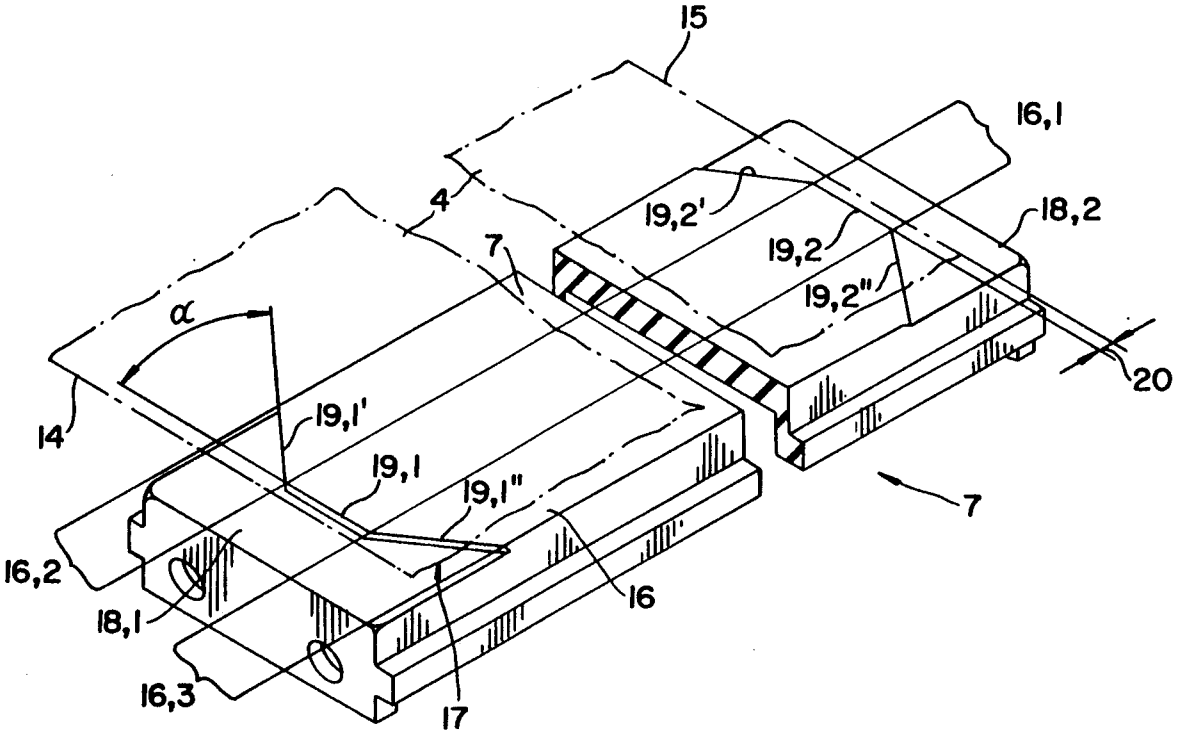
Figure 4:
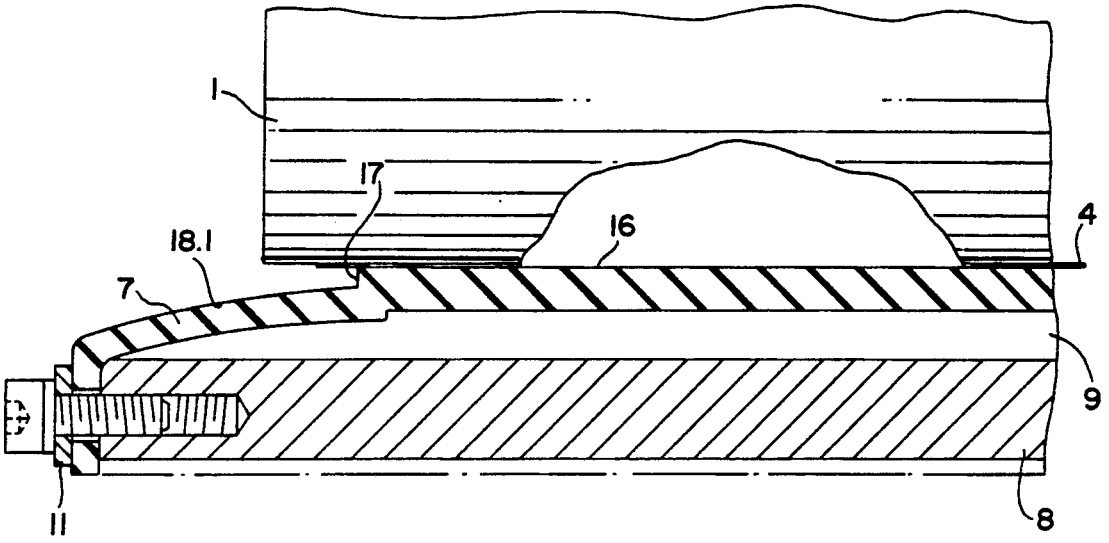
Figure 5:
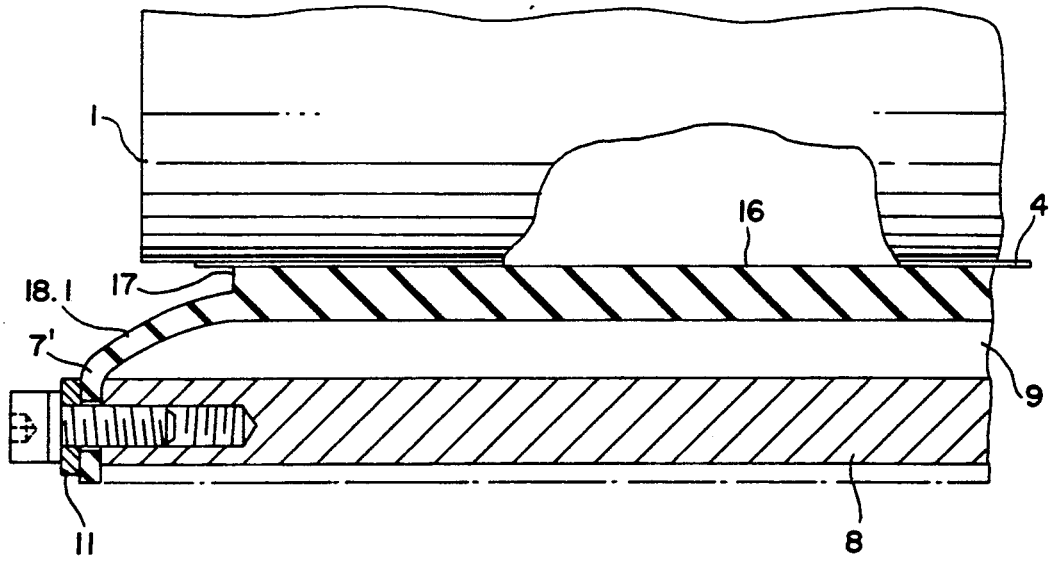

FIG. 3 is a perspective view of the diaphragm of FIGS. 1 and 2 constructed in accordance with the invention and shown in an arrangement with a cleaning-cloth web; and FIGS. 4 and 5 are fragmentary longitudinal sectional views of different embodiments of the diaphragm according to the invention, shown perpendicularly to a plane tangential to the outer cylindrical surface and in a phase wherein the cleaning-cloth web has been pressed against the outer cylindrical surface by the diaphragm.

Referring now to the drawings and, first, particularly to FIG. 1 thereof, there is illustrated therein the relationship between an outer cylindrical surface 1 (for example of a rubber-blanket cylinder of an offset printing press) and a cleaning device 2 according to the invention. In the interest of clarity and simplicity only the important parts of the cleaning device 2 are shown, namely one frame part 3 of a pair of frame parts which are disposed on opposite sides of the plane of the drawing of FIG. 1, and a cleaning-cloth web 4 wound on a spool 5 having a spool core 6 which is carried by the frame parts 3. Moreover, a diaphragm 7 and a clamping rail 8 defining a pressure chamber 9 therebetween are received in a profiled cross member 10 carried by the frame parts 3, two opposite edges of the diaphragm 7 being sealingly clamped between respective sealing surfaces of the cross member 10 and the clamping rail 8. One or more clamping screws 21 threadedly extend through the cross member 10 and engage the clamping rail 8 for sealingly clamping the edges of the diaphragm 7. The diaphragm 7, the clamping rail 8 and the cross-member 10, respectively, have elongated shapes, the cross sections of which are readily discernible in FIG. 1.

In order to form the pressure chamber 9, the diaphragm 7 is additionally sealingly connected at respective narrow end sides thereof to respective end faces of the clamping rail 8 as is apparent, for example, from FIG. 4. For this purpose, each end of the diaphragm 7 is clamped by respective screws 22 between a respective end face of the clamping rail 8 and a pressure plate 11. The cleaning-cloth web 4 is passed between the lateral surface 1 and a surface of the diaphragm 7 facing towards the lateral surface.

FIG. 1 further illustrates a phase of operation of the cleaning device wherein the diaphragm 7 is subjected to pressure on one side thereof by a pressurized fluid and presses a section of the cleaning-cloth web 4 against the outer cylindrical surface 1. As shown in FIG. 2, for this purpose, the pressurized fluid is introduced into the pressure chamber 9 through a pressure line 12 and through an adjoining connector 13, which is screwed into a threaded inlet bore of the clamping rail 8.

In FIG. 3, a diaphragm 7 according to the invention, which is formed of a rubber-elastic material, is shown separated from the hereinafore-described cleaning device and in a positionally correct relationship with respect to the cleaning-cloth web 4 shown in phantom. In this view, the cleaning-cloth web 4 extends above the diaphragm 7.

Web edges 14 and 15, respectively, of the cleaning-cloth web 4 extend perpendicularly to generating lines of the outer cylindrical surface 1 (not shown in FIG. 3). The surface of the diaphragm 7 facing towards the cleaning-cloth web 4 includes a raised first surface region, identified in its entirety by reference numeral 16, which is able to contact the cleaning-cloth web 4, at least when the diaphragm 7 is arched or bulges towards the cleaning-cloth web 4. The surface of the diaphragm 7 facing towards the cleaning-cloth web 4 further includes second surface regions 18.1 and 18.2, which are offset with respect to the first surface region 16 by means of a rebounding or recessed step 17. The raised first surface region 16 extends over a length slightly greater than the hereinafore-mentioned working width between first body edges 19.1 and 19.2 formed by the step 17 and extending parallel to the web edges 14 and 15. The web edges 14 and 15, respectively, of the cleaning-cloth web 4 project a respective distance 20 beyond the aforementioned length of the raised first surface region 16.

It is accordingly then possible to ensure that, when the diaphragm 7 is suitably arched or caused to bulge under the pressure of a fluid introduced into the pressure chamber 9, the diaphragm 7 presses the cleaning-cloth web 4 against the outer cylindrical surface 1 over a width defined by the first body edges 19.1 and 19.2. The second surface regions 18.1 and 18.2 offset by the step 17 do not come into contact with the outer cylindrical surface 1. Conversely, they ensure that a curvature of the raised first surface region 16 in the longitudinal direction of the elongated diaphragm 7, a curvature resulting from the arching or bulging of the diaphragm 7 under the pressure of the fluid, is reduced to extremely low values also in the surroundings of the first body edges 19.1 and 19.2. Consequently, the curvature of the diaphragm 7 in the longitudinal direction thereof, which is caused by the pressure of the fluid, occurs mainly in the regions of the diaphragm 7 forming the offset surface regions 18.1 and 18.2.

In the diaphragm 7 shown in FIG. 3, the first body edges 19.1 and 19.2 formed by the step 17 represent respective lateral borders of a central region 16.1 of the raised first surface region 16, while a respective end of each first body edge 19.1 and 19.2 is adjoined by respective second body edges 19.1', 19.1'' and 19.2', 19.2''. In this connection, the second body edges 19.1' and 19.2' form lateral borders of a first marginal region 16.2 and the second body edges 19.1'' and 19.2'' form lateral borders of a second marginal region 16.3 of the raised first surface region 16, the first marginal region 16.2 and the second marginal region 16.3, respectively, adjoining the central region 16.1. In this connection, the second body edges 19.1', 19.1'', 19.2', 19.2'' are so developed that, at a marked spacing or distance from the central region 16.1, a respective marginal region 16.2 and 16.3 is perceptibly narrower than the cleaning-cloth web 4. As described further hereinbefore, this construction ensures that the section of the cleaning-cloth web 4 which is pressed against the outer cylindrical surface 1 undergoes, at most, a negligible tapering towards the web edges 14, 15 of the cleaning-cloth web 4. In this regard, the second body edges 19.1', 19.1'', 19.2' 19.2'' do not have to be rectilinear, as shown in FIG. 3 of the drawings. Also, an angle enclosed between a first body edge 19.1 and 19.2, respectively, and a second body edge 19.1', 19.1'' and 19.2', 19.2'', respectively, can be adapted or adjusted to the respective requirements. In extreme cases, provision can be made for the raised first surface region 16 to have a step 17 all around it.

As mentioned hereinbefore, FIGS. 4 and 5 are fragmentary longitudinal sectional views of the diaphragm 7 perpendicular to a plane tangential to the outer cylindrical surface 1, and respectively illustrating an operating state in which the cleaning-cloth web 4 has been pressed against the outer cylindrical surface 1 by means of a diaphragm 7 (FIG. 4) or 7' (FIG. 5). In the case of the diaphragm 7 according to FIG. 4 which is formed of rubber-elastic material, the stop 17, while a basically uniform wall thickness of the diaphragm 7 is maintained, is formed in a region of the diaphragm 7 facing towards the cleaning-cloth web 4. On the other hand, in the case of the diaphragm 7' of the type shown in FIG. 5, offset surface regions 18.1', 18.2' of the diaphragm 7' (only wall thickness which is smaller by the height of the step 17 than a region of the diaphragm 7' forming the raised first surface region 16. Due to the relatively easier deformability of the offset surface regions 18.1' and 18.2' in the construction according to FIG. 5 in comparison with the construction according to FIG. 4, a smaller length of the diaphragm 7' transverse to the cleaning-cloth web 4 is required for raised first surface regions 16 of identical outlines and cleaning-cloth web 4 of identical width in both embodiments of the diaphragm 7 and 7'.

The foregoing is a description corresponding in substance to German Application No. P 40 08 159.1, dated Mar. 15, 1989, the International priority of which is being claimed for the instant application, and which is hereby made part of this application. Any material discrepancies between the foregoing specification and the aforementioned corresponding German application are to be resolved in favor of the latter.

I claim:

1. Cleaning device for a printing press for cleaning a rotating outer cylindrical surface of a roller or cylinder by means of a cleaning-cloth web having a given width and edges extending perpendicularly to generating lines of the outer cylindrical surface, comprising a diaphragm subjectible to pressure at a first side thereof by means of a pressurized fluid for pressing a section of the cleaning-cloth web against the outer cylindrical surface, said first side of said diaphragm facing away from the cleaning-cloth web, said diaphragm having a second side opposite said first side thereof and forming an outer surface subdivided into a first surface region and into second surface regions, said first surface region being raised with respect to said second surface regions, said first surface region extending between the edges of the cleaning-cloth web and having a first end terminating at a first step and a second end terminating at a second step, said first and said second steps being mutually spaced maximally a distance which is slightly smaller than the given width of the cleaning-cloth web, .said first surface region and one of said second surface regions, respectively, mutually adjoining said first and said second steps, respectively, said first and said second steps, respectively, falling off from said first surface region to said respective one of said second surface regions.

2. Cleaning device according to claim 1, wherein said diaphragm is formed of rubber-elastic material and, while a basically uniform wall thickness of said diaphragm is maintained, said step is formed in a region of said diaphragm facing towards the cleaning-cloth web.

3. Cleaning device according to claim 1, wherein said offset second surface regions have a wall thickness smaller by the height of said step than the wall thickness of a region of said diaphragm forming said raised first surface region.

4. Cleaning device according to claim 1, wherein said diaphragm is formed with first body edges partly defining said raised first surface region, said first body edges being formed by said step and extending parallel to edges of the cleaning-cloth web and laterally bordering a central region of said raised first surface region, said first body edges being respectively disposed between and at a slight distance from said edges, respectively, of the cleaning-cloth web, respective ends of each of said first body edges being adjoined by respective second body edges partly defining said raised first surface region of said diaphragm, said second body edges, respectively, laterally bordering a respective edge region adjoining said central region of said raised first surface region, said edge regions, respectively, being narrower than said cleaning-cloth web at least at a given distance from said central region of said raised first surface region.

* * * * *